US012760972B2

(12) United States Patent
Yang

(10) Patent No.: US 12,760,972 B2
(45) Date of Patent: Oct. 13, 2026

(54) CAPILLARY WOVEN MESH STRUCTURE

(71) Applicant: ASIA VITAL COMPONENTS (CHINA) CO., LTD., Shenzhen (CN)

(72) Inventor: Hsiu-Wei Yang, Shenzhen (CN)

(73) Assignee: ASIA VITAL COMPONENTS (CHINA) CO., LTD., Shenzhen (CN)

( * ) Notice: Subject to any disclaimer, the term of this patent is extended or adjusted under 35 U.S.C. 154(b) by 213 days.

(21) Appl. No.: 18/202,299

(22) Filed: May 26, 2023

(65) Prior Publication Data

US 2024/0393060 A1 Nov. 28, 2024

(51) Int. Cl.
*F28D 15/04* (2006.01)
*F28D 21/00* (2006.01)

(52) U.S. Cl.
CPC .... *F28D 15/046* (2013.01); *F28D 2021/0029* (2013.01)

(58) Field of Classification Search
CPC . F28D 15/046; F28D 15/04; F28D 2021/0029
See application file for complete search history.

(56) References Cited

U.S. PATENT DOCUMENTS

2007/0295494 A1* 12/2007 Mayer ..... F28D 15/0233 29/890.032
2011/0088877 A1* 4/2011 Oniki ..... H01L 23/427 29/890.032
2015/0176918 A1 6/2015 Pai

FOREIGN PATENT DOCUMENTS

| | | | | |
|---|---|---|---|---|
| CN | 2784857 Y | * | 5/2006 | ..... F28D 15/046 |
| CN | 102538529 A | * | 7/2012 | ..... F28D 15/046 |
| CN | 104748596 A | | 7/2015 | |
| CN | 105258543 A | | 1/2016 | |
| CN | 110972451 A | | 4/2020 | |
| CN | 113566624 A | | 10/2021 | |
| CN | 113566626 A | * | 10/2021 | |
| CN | 113804033 A | * | 12/2021 | |
| CN | 219637447 U | | 9/2023 | |
| JP | 2004022603 A | * | 1/2004 | |
| JP | 2022-122185 A | | 8/2022 | |
| TW | M272067 U | | 8/2005 | |
| TW | M272068 U | | 8/2005 | |
| TW | M301497 U | | 11/2006 | |
| TW | 202200951 A | | 1/2022 | |

(Continued)

OTHER PUBLICATIONS

English translation of CN11356626A (Year: 2021).*

(Continued)

*Primary Examiner* — Tho V Duong
(74) *Attorney, Agent, or Firm* — Demian K. Jackson; Jackson IPG PLLC

(57) ABSTRACT

A capillary woven mesh structure includes multiple weaving lines, which are woven with each other to form the capillary woven mesh structure. A line set is composed of multiple weaving lines. The weaving line and the line set respectively extend in a first weaving direction and a second weaving direction, whereby the single weaving line and one line set sequentially repeatedly intersect (and overlap with) each other and are woven with each other to form the capillary woven mesh structure. The capillary woven mesh structure is applied to a two-phase fluid heat dissipation unit to greatly enhance the capillary attraction and the water collection (containing) ability so as to promote the heat transfer performance.

7 Claims, 10 Drawing Sheets

(56) References Cited

FOREIGN PATENT DOCUMENTS

| | | |
|---|---|---|
| TW | M630119 U | 8/2022 |
| TW | M634207 U | 11/2022 |
| TW | M639337 U | 4/2023 |
| TW | M643911 U | 7/2023 |

OTHER PUBLICATIONS

English translation CN 2784857Y (Year: 2006).*
Search Report dated Dec. 8, 2023 issued by Taiwan Intellectual Property Office for counterpart application No. 112117002.
Search Report dated Sep. 6, 2024 issued by Taiwan Intellectual Property Office for counterpart application No. 112117002.
Search Report dated Jun. 4, 2025 issued by China National Intellectual Property Administration for counterpart application No. 2023105126537.

* cited by examiner

CAPILLARY WOVEN MESH STRUCTURE

BACKGROUND OF THE INVENTION

1. Field of the Invention

The present invention relates generally to a capillary structure, and more particularly to a capillary woven mesh structure. The capillary woven mesh structure has better capillary attraction and water collection (containing) ability to enhance the capillary heat transfer performance.

2. Description of the Related Art

Along with the rapid advance of technologic and scientific industries, currently, many 3C electronic products are designed with lightweight, thin, short and small size. Under such circumstance, the heat dissipation unit disposed in the electronic product for dissipating or conducting the heat must be thinned in accordance with the thin electronic product. In this case, the heat dissipation unit employing transformation between two phases of a working fluid, such as a heat pipe or a vapor chamber, has been stressed. However, the heat conductivity of the two-phase fluid heat dissipation unit is mostly determined by the capillary structure.

Please refer to FIG. 5, which shows a flat and thin woven mesh capillary structure applied to an ultra-thin heat pipe. The flat and thin woven mesh capillary structure 5 includes multiple longitudinal lines 51 and multiple latitudinal lines 52, which repeatedly intersect each other and are woven with each other to form the flat and thin woven mesh capillary structure 5. Each two adjacent longitudinal lines 51 and each two latitudinal lines 52 together define a mesh. Each of the longitudinal and latitudinal lines has multiple intersection sections 53 and multiple connection sections 54 serially connected between each two adjacent intersection sections 53. Each the intersection section 53 of the longitudinal and latitudinal lines has a flat cross section, whereby the woven mesh capillary structure 5 is flattened and thinned.

However, the aforesaid conventional woven mesh capillary structure is simply composed of the longitudinal lines 51 and the latitudinal lines 52, which repeatedly intersect each other and are woven with each other. The longitudinal and latitudinal lines 51, 52 have the same diameter (thickness). Therefore, after the longitudinal and latitudinal lines 51, 52 longitudinally and latitudinally intersect each other and are woven with each other, multiple voids with the same fixed size are formed in the woven mesh capillary structure. In addition, the number of the voids and the number of the meshes of the woven mesh capillary structure are fixed. As a result, the application of the capillary attraction of the woven mesh capillary structure, (such as the enhancement of the water containing (collection) ability and the transverse water absorption ability of the entire woven mesh capillary structure or a local section of the woven mesh capillary structure), is too monotonous so that the woven mesh capillary structure cannot be flexibly utilized.

Therefore, the conventional woven mesh capillary structure can simply provide a limited number of voids and a limited number of meshes with the same size for absorbing the working fluid. In this case, the conventional woven mesh capillary structure cannot be freely designed in accordance with the type of the two-phase fluid heat dissipation unit to satisfy different heat dissipation requirements of the respective sections of the two-phase fluid heat dissipation unit.

Therefore, the water containing ability of the woven mesh capillary structure is insufficient and the capillary attraction of the entire woven mesh capillary structure is poor. As a result, the two-phase fluid heat dissipation unit employing the woven mesh capillary structure cannot be flexibly utilized so that the backflowing is too slow and the water content of the evaporation face of the two-phase fluid heat dissipation unit is insufficient. Consequently, dry-out may take place on the evaporation face to lower the heat transfer performance.

It is therefore tried by the applicant to provide a capillary woven mesh structure, which has better capillary attraction and water containing ability to solve the problems of the conventional woven mesh capillary structure disposed in the heat dissipation unit.

SUMMARY OF THE INVENTION

It is therefore a primary object of the present invention to provide a capillary woven mesh structure including multiple weaving lines. A line set is composed of multiple weaving lines. The single weaving line and one line set sequentially repeatedly intersect and overlap with each other and are woven with each other to form the capillary woven mesh structure, wherein the line diameters of the respective weaving lines of the line set are selectively partially the same, partially different from each other, all the same or all different from each other. Therefore, the capillary woven mesh structure has more voids with the same size or different sizes so that the capillary attraction and water collection (containing) ability of the capillary woven mesh structure are greatly enhanced to promote the heat transfer performance.

To achieve the above and other objects, the capillary woven mesh structure of the present invention is applied to and disposed in a two-phase fluid heat dissipation unit to provide capillary action. The capillary woven mesh structure includes multiple weaving lines. A line set is composed of multiple weaving lines. The weaving line and the line set respectively extend in a first weaving direction and a second weaving direction. The single weaving line and one line set sequentially repeatedly intersect (and overlap with) each other and are woven with each other to form the capillary woven mesh structure. The line diameters of the respective weaving lines are selectively partially the same, partially different from each other, all the same or all different from each other.

Accordingly, the entire weaving section (area) of the capillary woven mesh structure or a local weaving section (area) of the capillary woven mesh structure of the present invention is woven from the single weaving line and one line set collocated with the weaving lines. The line set is composed of multiple weaving lines with the same or different thicknesses. The number and the line diameters of the weaving lines are different from and in a certain proportion to the number and the line diameters of the weaving lines of the line set. The single weaving line and one line set sequentially repeatedly intersect (and overlap with) each other and are woven with each other. Therefore, the number of the voids with different sizes of the capillary woven mesh structure is increased to form a dense and firm mesh structure having greater capillary attraction and better water collection (containing) ability to enhance the capillary action. Moreover, the capillary woven mesh structure can effectively directionally quickly guide the working fluid (to flow back) and fully spread the working fluid over the evaporation face of the two-phase fluid heat dissipation unit.

Accordingly, the water collection (containing) ability of the evaporation face of the two-phase fluid heat dissipation unit is enhanced to avoid dry-out and promote the heat exchange efficiency.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
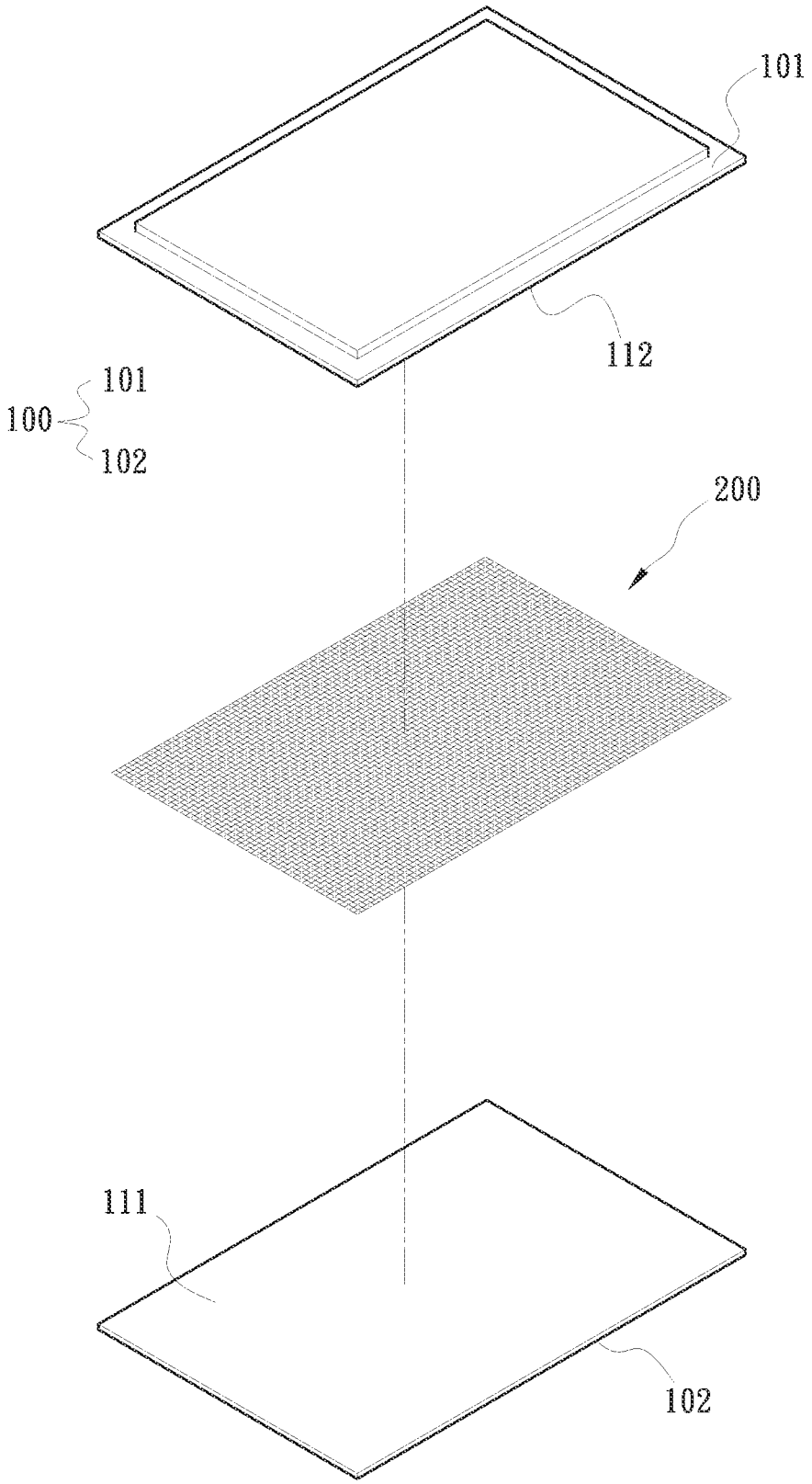
FIG. 1 is a perspective exploded view showing that the capillary mesh woven structure of the present invention is applied to a two-phase fluid heat dissipation unit.
Figure 2A:
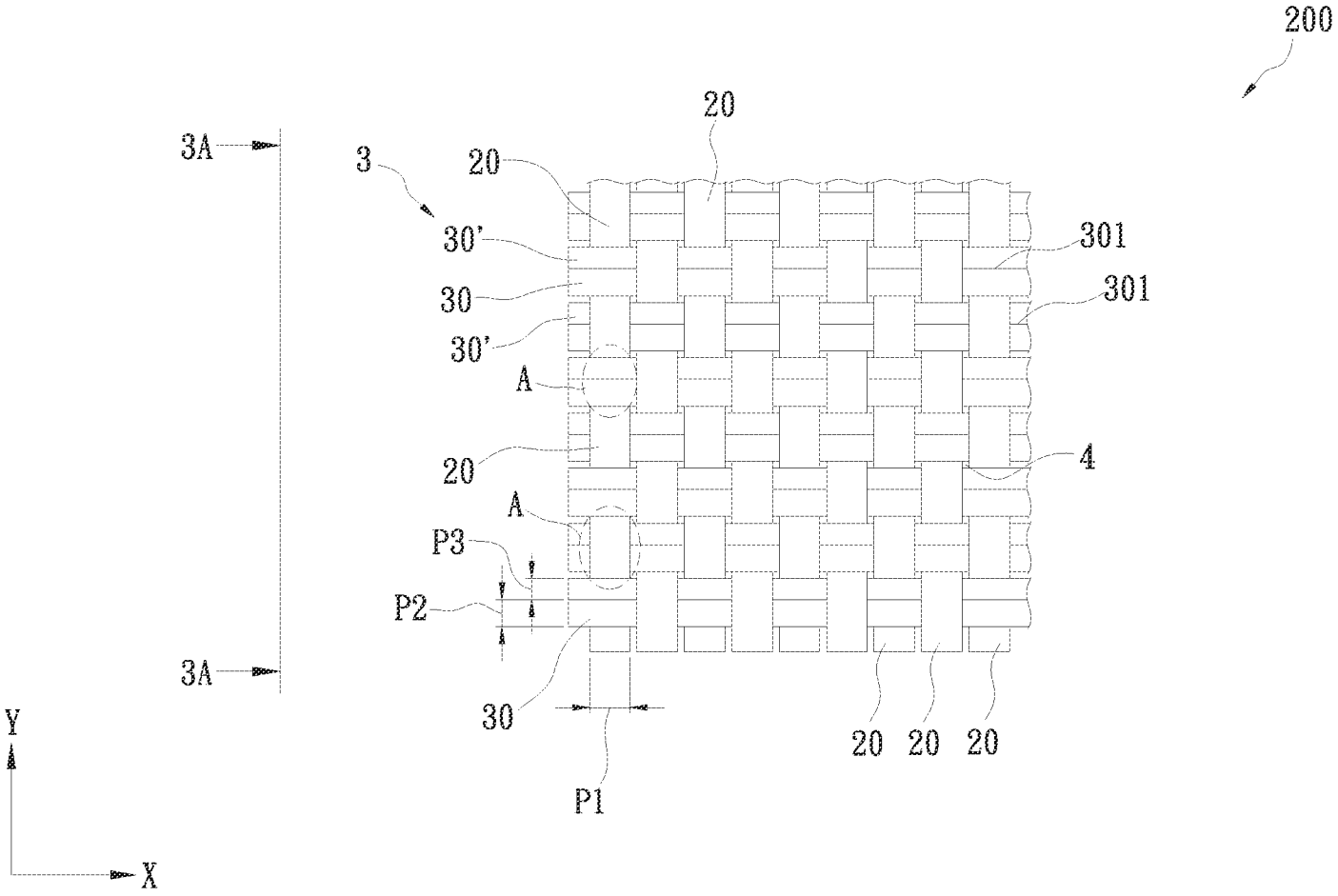
FIG. 2A is a top view of the capillary woven mesh structure of the present invention.
Figure 2B:
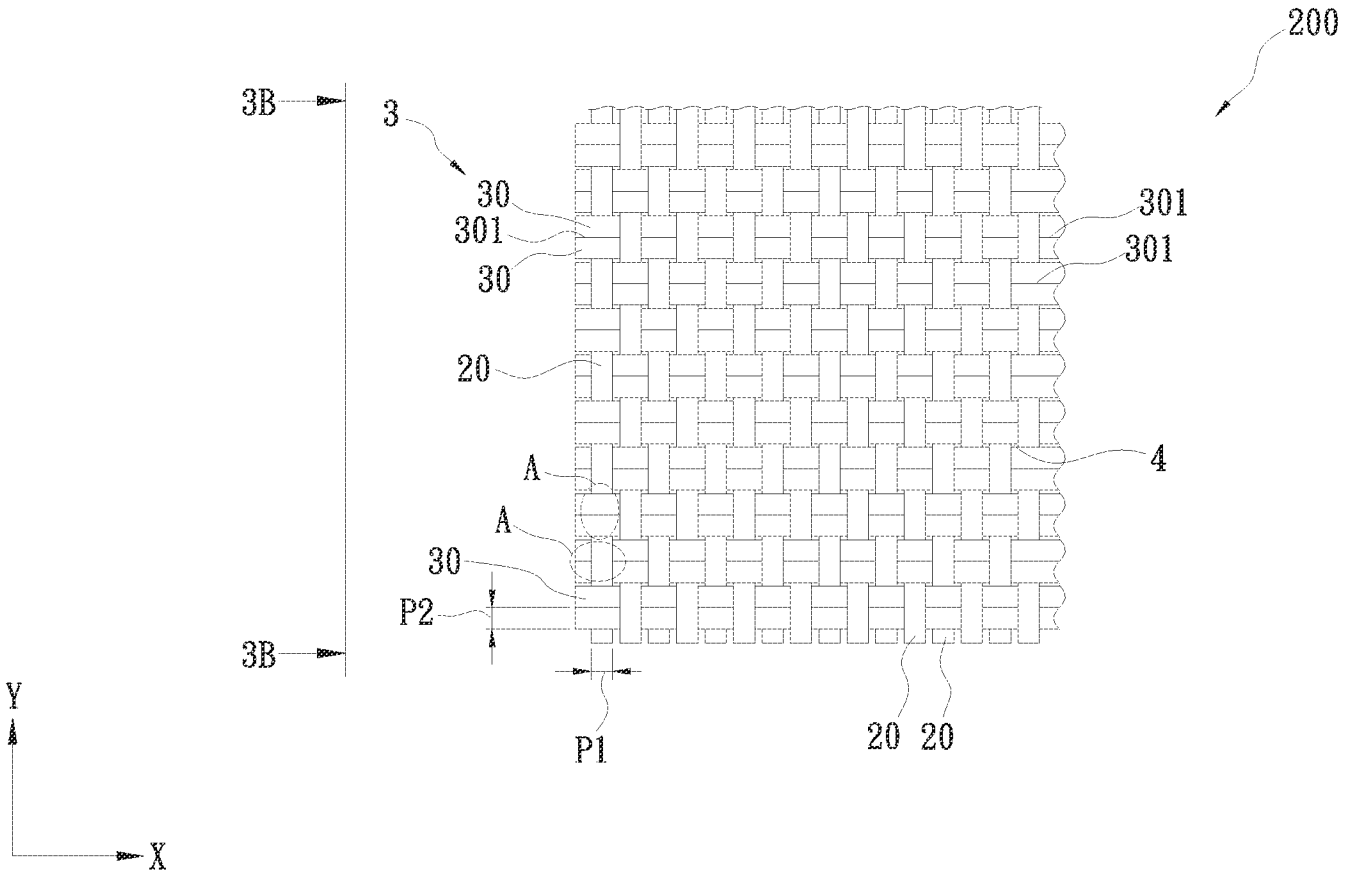
FIG. 2B is a top view of another embodiment of the capillary woven mesh structure of the present invention.
Figure 2C:
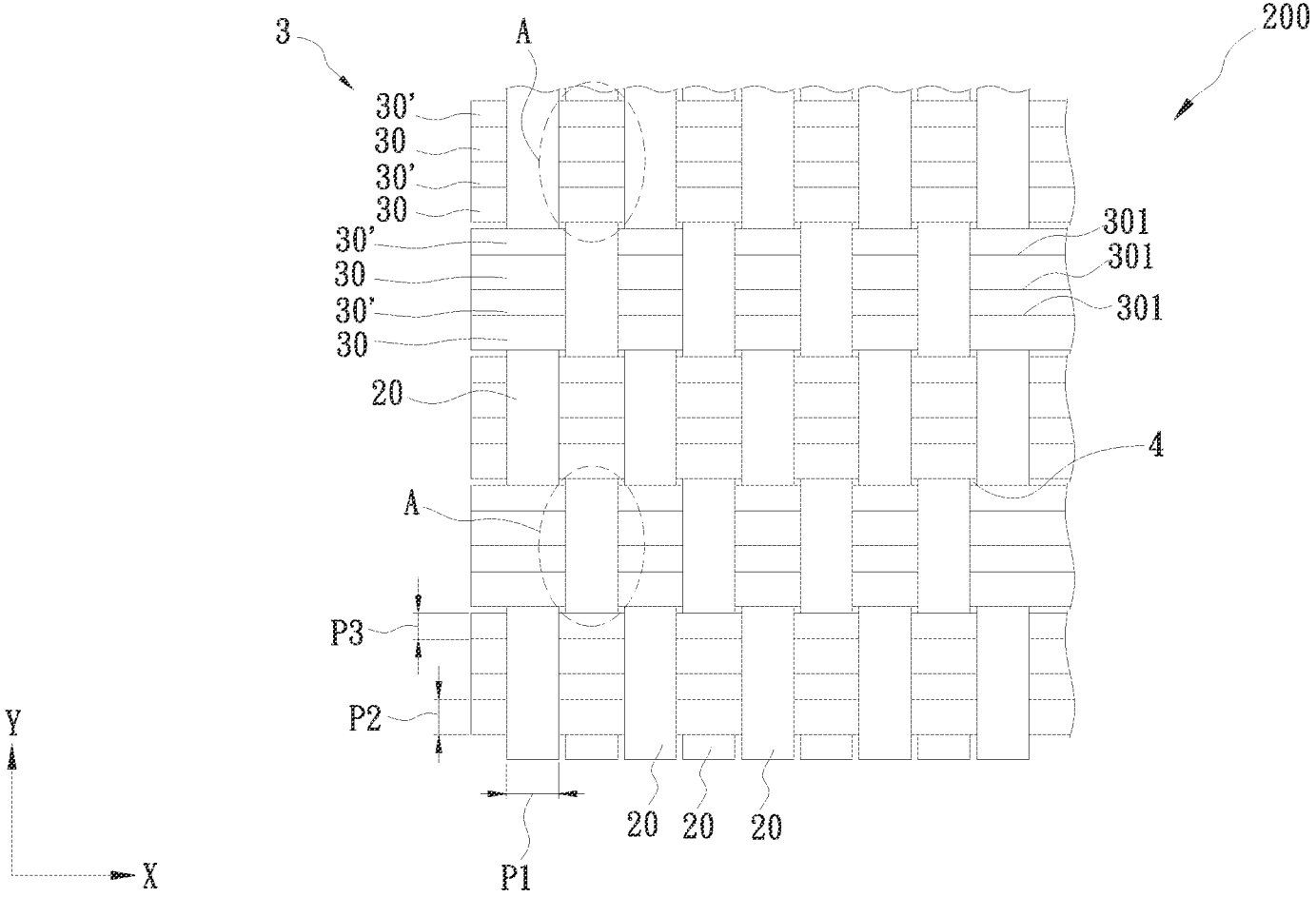
FIG. 2C is a top view of still another embodiment of the capillary woven mesh structure of the present invention.
Figure 2D:
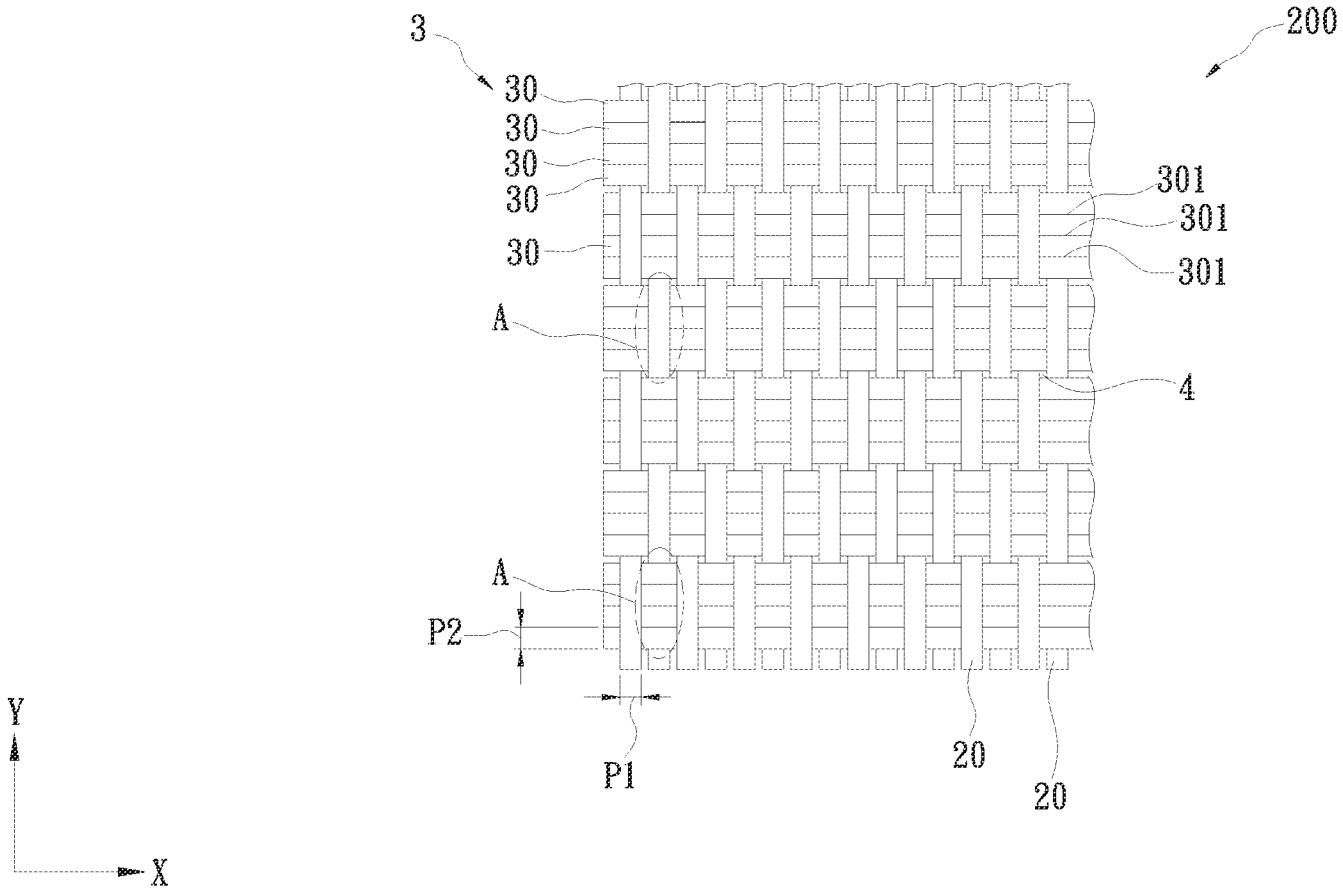
FIG. 2D is a top view of still another embodiment of the capillary woven mesh structure of the present invention.
Figure 2E:
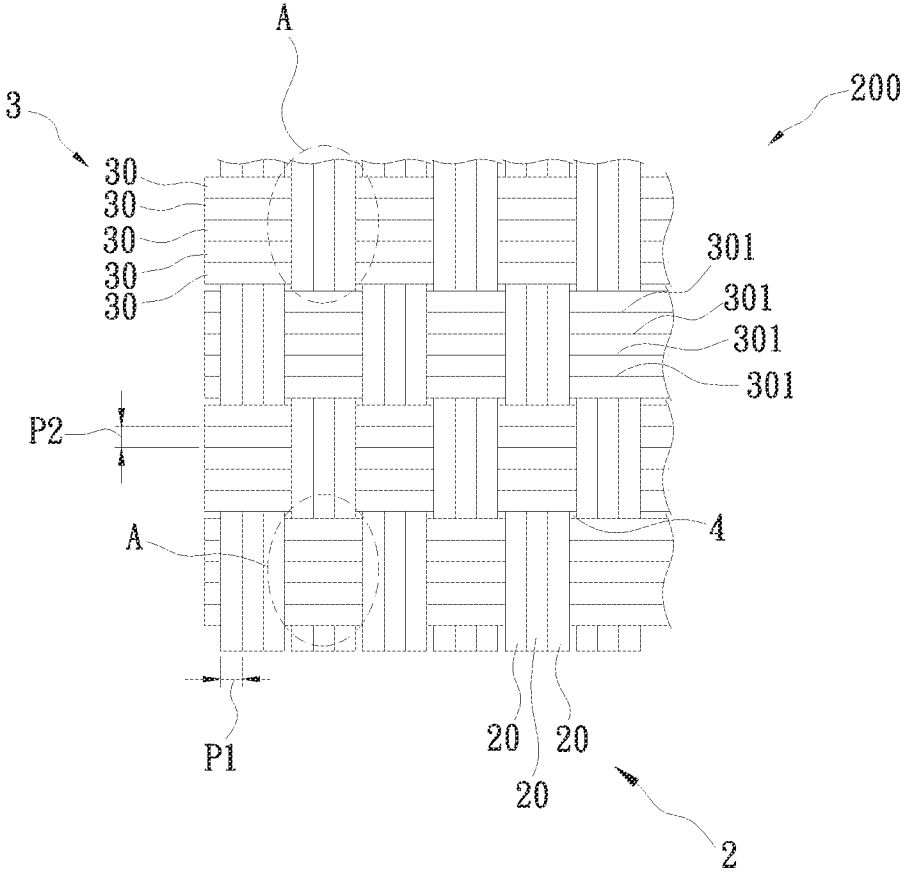
FIG. 2E is a top view of still another embodiment of the capillary woven mesh structure of the present invention.
Figure 3A:
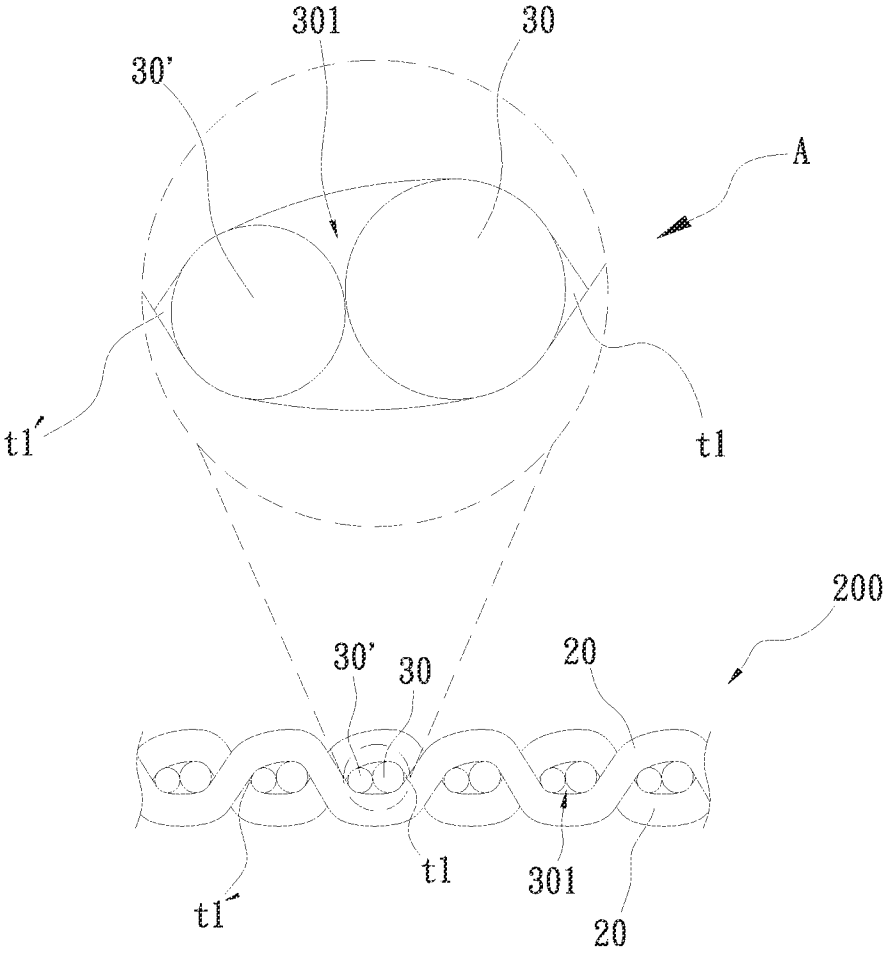
FIG. 3A is a left side view of the capillary woven mesh structure of the present invention according to FIG. 2A.
Figure 3B:
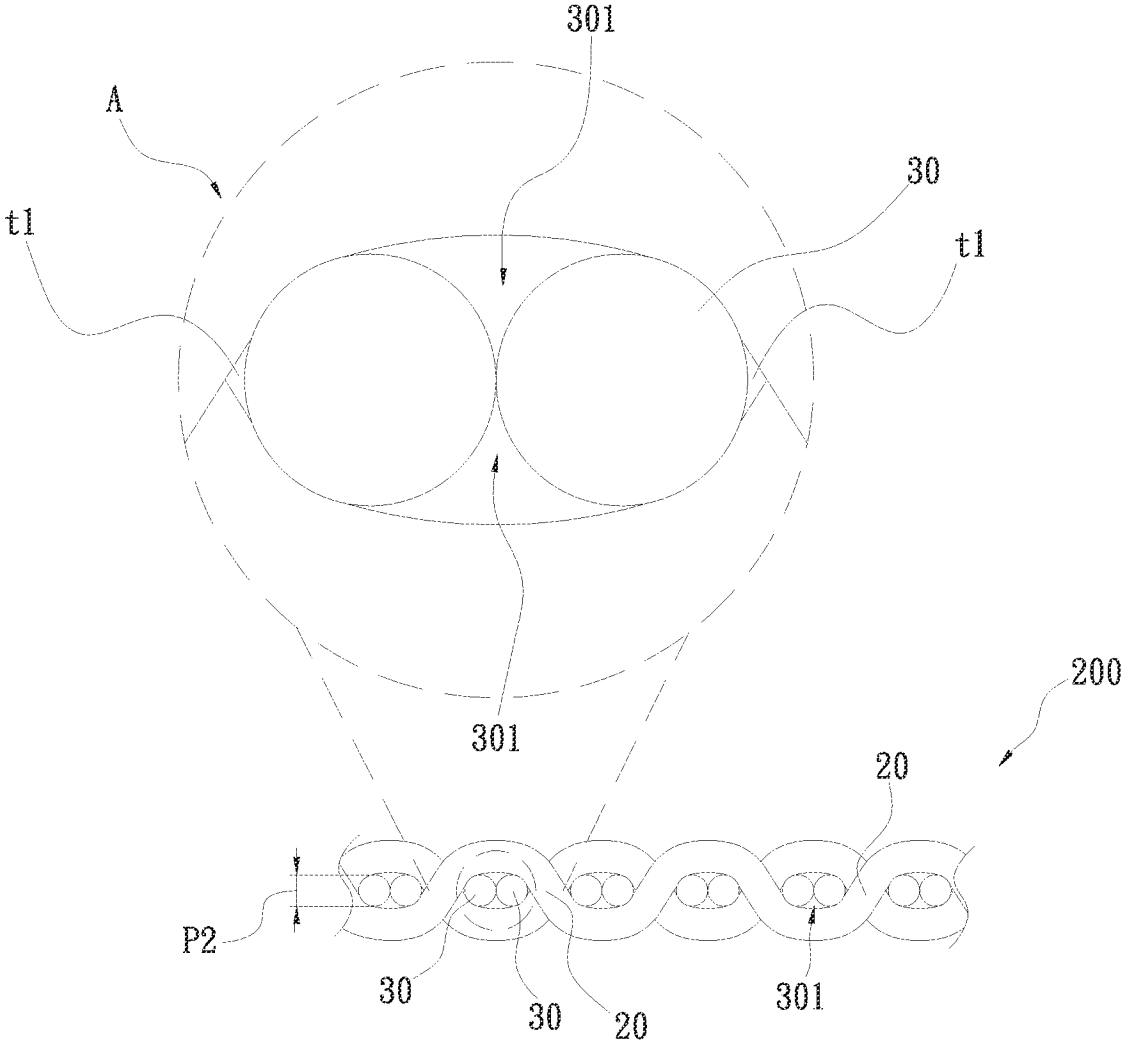
FIG. 3B is a left side view of the capillary woven mesh structure of the present invention according to FIG. 2B.
Figure 4:
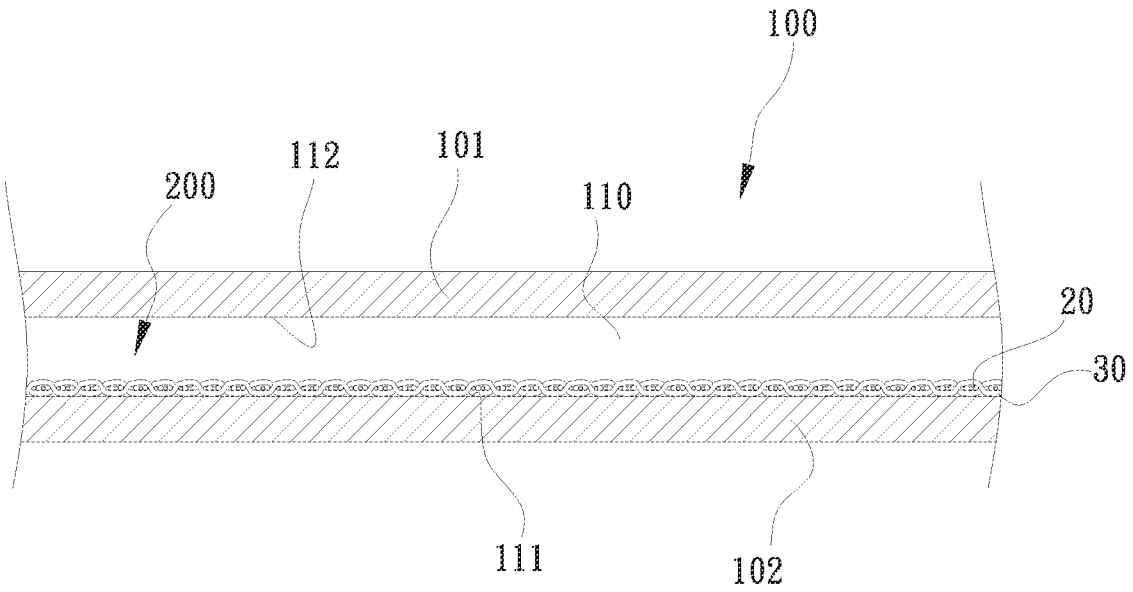
FIG. 4 is a sectional view showing that the capillary woven mesh structure of the present invention is disposed in the two-phase fluid heat dissipation unit.
Figure 5:
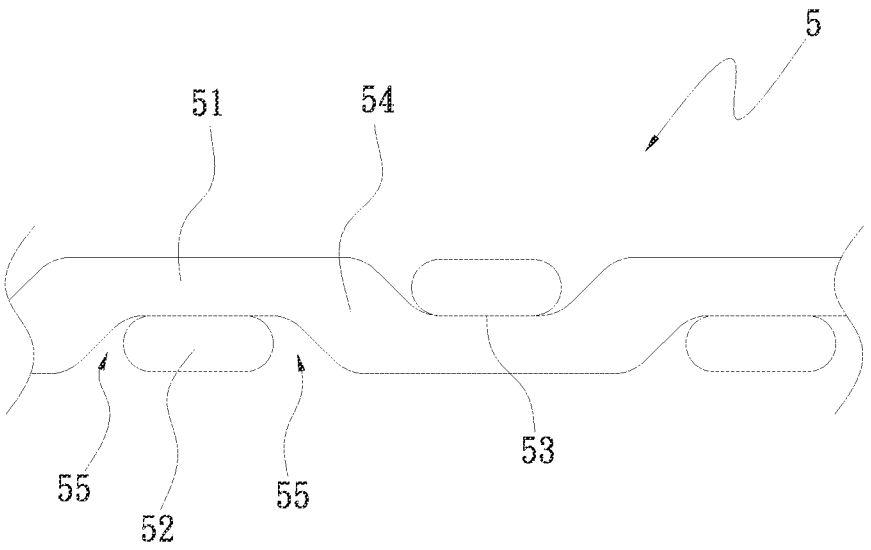
(PRIOR ART) Fig. 5
FIG. 5 is a side view of a conventional thinned flat-type woven mesh capillary structure.

Please refer to FIGS. 1, 2A, 2B, 2C, 2D, 2E, 3A and 3B, which show the capillary woven mesh structure of the present invention. The capillary woven mesh structure 200 is disposed in a two-phase fluid heat dissipation unit 100 (such as a vapor chamber, a flat-plate heat pipe, a heat pipe, a loop-type heat pipe or any other two-phase fluid device). As shown in FIGS. 1 and 4, the two-phase fluid heat dissipation unit 100 has a case body. In the present invention, a vapor chamber is selected as an example of the two-phase fluid heat dissipation unit 100 for illustration purposes. The case body includes an upper plate 101 and a lower plate 102. The upper plate 101 is mated with the lower plate 102 to together define a chamber 110, in which a working fluid is filled (as shown in FIG. 4). The capillary woven mesh structure 200 is at least selectively disposed on an inner surface of the upper plate 101 and/or the lower plate 102.

The capillary woven mesh structure 200 includes multiple weaving lines, which respectively extend in two different directions (such as a first weaving direction and a second weaving direction). The weaving lines sequentially repeatedly intersect and overlap with each other and are woven with each other to form the capillary woven mesh structure 200. In a preferred embodiment, single weaving line is collocated with one line set (which is composed of multiple weaving lines with the same thickness or different thicknesses and different numbers). The single weaving line and one line set sequentially repeatedly intersect (and overlap with) each other and are woven with each other to form the capillary woven mesh structure 200. In this embodiment, the single weaving line is, but not limited to, selectively the longitudinal line 20, while the line set 3 is, but not limited to, selectively composed of multiple latitudinal lines 30 for illustration. As shown in FIGS. 2A, 2B, 2C and 2D, at least two latitudinal lines, that is, a first latitudinal line 30 and a second latitudinal 30' are selectively arranged as a latitudinal line set (line set) 3 (the latitudinal line set 3 can alternatively selectively have more than two, such as three, four or more, latitudinal lines in accordance with different application requirements). The first and second latitudinal lines 30, 30' of the latitudinal line sets (line sets) 3 have the same line diameter or different line diameters (thicknesses) and are tightly side-by-side arranged. The latitudinal line set 3 extends in a second weaving direction X (such as transverse direction), while the single longitudinal line 20 extends in a first weaving direction Y (such as longitudinal direction). Accordingly, the latitudinal line set 3 and the longitudinal line 20 extend in different directions to sequentially repeatedly intersect and overlap with each other and are woven with each other to form the capillary mesh woven structure 200.

In addition, in the same weaving area, the two latitudinal lines (the first and second latitudinal lines 30, 30') of the latitudinal line set 3 respectively have a first latitudinal line diameter P2 and a second latitudinal line diameter P3, which are different from each other. The first latitudinal line diameter P2 is larger than the second latitudinal line diameter P3. Both the first latitudinal line diameter P2 and the second latitudinal line diameter P3 are smaller than the longitudinal line diameter P1 of each longitudinal line 20. Moreover, the longitudinal line diameter P1 of each longitudinal line 20 is larger than or equal to the sum of the first latitudinal line diameter P2 and the second latitudinal line diameter P3 of each latitudinal line set 3. Accordingly, the numbers of the first and second latitudinal lines 30, 30' with different thicknesses are increased to define more voids (gaps) t1, t1' with different sizes in the capillary woven mesh structure 200. Please further refer to FIGS. 2A, 2B, 3A and 3B. To speak more specifically, the longitudinal lines 20 and the first and second latitudinal lines 30, 30' of the latitudinal line sets 3 with the same thickness or different thicknesses sequentially repeatedly intersect (and overlap with) each other and are woven with each other to form multiple intersection sections A. In each intersection section A, two voids (gaps) t1, t1' with the same size or different sizes are defined between the longitudinal line 20 and outer circumferences of the first and second latitudinal lines 30, 30' with the same thickness or different thicknesses. Accordingly, the capillary woven mesh structure 200 has numerous voids (gaps) t1, t1' with the same size or different sizes (as shown in FIGS. 3A and 3B) and the numbers of the voids (gaps) t1, t1' are increased. In addition, each two adjacent longitudinal lines 20 and the first and second latitudinal lines 30, 30' of each two adjacent latitudinal line sets 3 together define a mesh 4.

In addition, the longitudinal line 20 of the present invention has a longitudinal line diameter P1 and a circular cross section or a noncircular cross section (such as an elliptic cross section, a flat cross section, a beehive-shaped cross section or any other geometrical cross section).

The first and second latitudinal lines 30, 30' of the latitudinal line set 3 respectively have the first latitudinal line diameter P2 and the second latitudinal line diameter P3 different from each other. As shown in FIG. 3A, (which is a left side view of the capillary woven mesh structure of the present invention according to FIG. 2A), the first and second latitudinal lines 30, 30' have the same or different cross-sectional configurations, for example, a larger circular cross section and a smaller circular cross section, or two noncircular cross sections or two cross sections with any other geometrical configuration. In addition, at least two flow-guiding micro-passages 301 are formed between the first and second latitudinal lines 30, 30' of the latitudinal line set 3. The two flow-guiding micro-passages 301 are respectively positioned above and under contact sections of the first and second latitudinal lines 30, 30' (as shown in FIG. 3A) and extend in a lengthwise direction of the first and second latitudinal lines 30, 30'. Alternatively, as shown in FIGS. 2B and 3B, the latitudinal lines 30 of the latitudinal line set 3 have the same latitudinal line diameter P2. Moreover, the latitudinal lines 30 of the latitudinal line set 3 respectively have two circular cross sections (or two noncircular cross sections or two cross sections with any other geometrical configuration), which are finely identical to each other.

As shown in FIGS. 2C and 2D, in a modified embodiment, the single longitudinal line 20 is collocated with one latitudinal line sets 3 having four latitudinal lines 30, 30', 30, 30' with the same thickness or different thicknesses. As shown in FIG. 2E, in still a modified embodiment, the three longitudinal lines 20 with the same line diameter or different line diameters are selectively collocated with one latitudinal line set 3 having five latitudinal lines 30 with the same line diameter or different line diameters. Accordingly, the number and the line diameters of the longitudinal lines are different from and in a certain proportion to the number and the line diameters of the collocated latitudinal lines. Moreover, the line diameters of the longitudinal lines can be the same or different from each other. Also, the line diameters of the collocated latitudinal lines can be the same or different from each other. The multiple longitudinal lines 20 and the multiple latitudinal lines 30 sequentially repeatedly intersect and overlap with each other and are woven with each other to form the capillary woven mesh structure 200.

In the above embodiment, the longitudinal lines and the latitudinal lines can be switched, that is, the single weaving line can be alternatively the latitudinal line, while the line set can be alternatively the longitudinal line set, which is composed of multiple longitudinal lines.

The weaving lines can be made of a metal material or a nonmetal material (such as plastic or stone material) with a certain flexibility and good heat conductivity. That is, the longitudinal lines 20 and the latitudinal lines 30, 30' can be made of the same material (or different materials) collocated with each other for different applications.

Further referring to FIGS. 1 and 4 and complementarily referring to FIGS. 2A, 2B, 2C, 2D, 2E, 3A and 3B, an outer side of the lower plate 102 of the two-phase fluid heat dissipation unit 100 is attached to and in contact with a heat source (such as a central processing unit or a graphics processing unit or any other electronic unit, not shown). An inner side of the lower plate 102 serves as an evaporation face 111, while an inner side of the upper plate 101 serves as a condensation face 112 opposite to the evaporation face 111. The capillary woven mesh structure 200 of the present invention can be selectively disposed on the evaporation face 111 or the condensation face 112. In this embodiment, the capillary woven mesh structure 200 is selectively disposed on the evaporation face 111. When the two-phase fluid heat dissipation unit 100 works, the lower plate 102 of the two-phase fluid heat dissipation unit 100 absorbs the heat of the heat source and the heat is transferred to the evaporation face 111, whereby the liquid working fluid on the evaporation face 111 is quickly evaporated into vapor working fluid, which quickly flows to the condensation face 112. After the condensation face 112 heat-exchanges with the external air, the vapor working fluid is again condensed into the liquid working fluid. Then, under gravity or the capillary attraction of the capillary structure, the liquid working fluid goes from the condensation face 112 back to the inner side of the lower plate 102. In the capillary woven mesh structure 200 of the present invention, the longitudinal lines 20 and the first and second latitudinal lines 30, 30' are collocated and woven with each other. The number and the line diameters of the longitudinal lines 20 are different from and in a certain proportion to the number and the line diameters of the first and second latitudinal lines 30, 30'. Moreover, the line diameters of the longitudinal lines 20 can be the same or different from each other. Also, the line diameters of the first and second latitudinal lines 30, 30' can be the same or different from each other and the number of the first latitudinal lines 30 can be different from and in a certain proportion to the number of the second latitudinal lines 30'. Therefore, the capillary woven mesh structure 200 has more voids (gaps) t1, t1' with different sizes and more flow-guiding micro-passages 301 for speeding the backflowing of the working fluid from the condensation face 112 to the evaporation face 111. In addition, the voids (gaps) t1, t1' and the flow-guiding micro-passages 301 of the capillary woven mesh structure 200 serve to directionally guide the working fluid to quickly spread over the evaporation face 111, whereby the evaporation face 111 has better water collection (containing) ability to avoid dry-out. Accordingly, the rate of boiling and evaporation of the working fluid on the evaporation face 111 in response to the temperature is enhanced. Moreover, not only the condensed working fluid can quickly continuously flow from the condensation face 112 back to the evaporation face 111 to avoid dry-out, but also the next circulation between heat absorption and evaporation and heat release and condensation can be quickly performed. Therefore, the transformation between the liquid phase and the vapor phase of the working fluid is continuously circularly takes place to continuously transfer the heat. Accordingly, the circular transformation between the liquid phase and the vapor phase of the working fluid in the chamber 110 is effectively speeded to enhance the heat transfer efficiency for the high-temperature area of the heat source so as to promote the heat dissipation performance. Therefore, the two-phase fluid heat dissipation unit 100 can achieve very good heat spreading and heat dissipation effect.

In practice, the entire weaving section (area) or a local weaving section (area) of the capillary woven mesh structure 200 of the present invention is woven from the single weaving line (such as the longitudinal line 20) and one cooperative line set (such as the latitudinal line set 3). Numerous voids (gaps) t1, t1' are defined between the longitudinal lines 20 and the latitudinal line sets 3 to enhance the water collection (containing) ability and capillary action. Moreover, according to the requirement for enhancement of any or both of the water collection (containing) ability and capillary action, the line diameters of the longitudinal lines 20 and the line diameters of the first and second latitudinal lines 30, 30' of the latitudinal line sets 3 of the capillary woven mesh structure 200 can be adjusted so as to adjust the sizes of the voids (gaps) or adjust the intervals between the longitudinal lines 20, 20 and/or the first and second latitudinal lines 30, 30' so as to adjust the density between the longitudinal lines 20 and the latitudinal lines 30 (30'). In this case, the capillary woven mesh structure 200 can be freely designed in accordance with different types of the two-phase fluid heat dissipation unit 100 (such as vapor chamber or heat pipe) to satisfy different heat dissipation requirements of the respective sections of the two-phase fluid heat dissipation unit 100.

Furthermore, the capillary woven mesh structure 200 arranged in the position where the heat source is positioned, (that is, the evaporation face 111), can be disposed on a section of the evaporation face 111 as one single block or disposed on multiple sections of the evaporation face 111 as multiple blocks or disposed over the entire evaporation face 111 in accordance with the distribution state of the high-temperature sections of the heat source.

Accordingly, the entire weaving section (area) of the capillary woven mesh structure 200 of the present invention is, but not limited to, formed of the single weaving line (such as the longitudinal line 20) and one cooperative line set (such as the latitudinal line set 3 which is composed of multiple latitudinal lines 30, 30' with the same or different thicknesses). The single longitudinal line 20 and one latitudinal line set 3 are collocated and woven with each other. Alternatively, in another embodiment, only a local weaving section of the capillary woven mesh structure 200 is woven from the single weaving line (such as the longitudinal line 20) and one cooperative line set (such as the latitudinal line set 3 which is composed of multiple latitudinal lines 30, 30' with the same or different thicknesses), while the remaining section of the capillary woven mesh structure 200 is conventionally woven from the multiple longitudinal lines 20 and the multiple latitudinal lines 30. For example, the capillary woven mesh structure 200 has a heat source contact section positioned at the center of the capillary woven mesh structure 200 corresponding to a heat source and a peripheral section positioned around the heat source contact section. The heat source contact section is conventionally woven from multiple longitudinal lines and multiple latitudinal lines, which sequentially repeatedly intersect (and overlap with) each other, while the peripheral section is woven from the single longitudinal line 20 and one cooperative latitudinal line set 3 having multiple latitudinal lines with the same thickness or different thicknesses, which sequentially repeatedly intersect (and overlap with) each other. To speak more specifically, the heat source contact section of the capillary woven mesh structure 200 is disposed in the chamber 110 of the two-phase fluid heat dissipation unit 100 corresponding to the evaporation face 111 in contact with the heat source. After the liquid working fluid contained in the heat source contact section of the capillary woven mesh structure 200 is heated, the liquid working fluid is quickly evaporated into the vapor working fluid. The peripheral section of the capillary woven mesh structure 200 has greater capillary attraction and better water collection (containing) ability so that the condensed working fluid can more quickly flow back to the peripheral section around the heat source contact section. Accordingly, the liquid working fluid can be collected (and contained) in the peripheral section and supplied to the heat source contact section at a proper time to avoid dry-out of the evaporation face 111.

Alternatively, as necessary, any of the heat source contact section and the peripheral section of the capillary woven mesh structure 200 of the present invention can be formed of the single weaving line and one line set collocated with the multiple weaving lines.

The present invention has been described with the above embodiments thereof and it is understood that many changes and modifications in such as the form or layout pattern or practicing step of the above embodiments can be carried out without departing from the scope and the spirit of the invention that is intended to be limited only by the appended claims.

What is claimed is:

1. A capillary woven mesh structure applied to and disposed in a two-phase fluid heat dissipation unit, the capillary woven mesh structure formed of multiple longitudinal single weaving lines extending in a first longitudinal weaving direction and cooperative multiple latitudinal line sets, each latitudinal line set being composed of multiple latitudinal weaving lines arranged side-by-side in parallel contact with each other, extending in a second latitudinal weaving direction, and wherein line diameters of the respective latitudinal weaving lines of each latitudinal line set are different from each other, the longitudinal single weaving lines and the latitudinal line sets sequentially repeatedly intersecting and overlapping with each other, forming at least two flow-guiding micro-passages at each intersection therebetween, and being collocated and woven with each other to form the capillary woven mesh structure and enhance the capillary attraction and water collection ability thereof.

2. The capillary woven mesh structure as claimed in claim 1, wherein at least one of the multiple latitudinal weaving lines of the multiple latitudinal line sets has a circular cross section.

3. The capillary woven mesh structure as claimed in claim 1, wherein the multiple longitudinal single weaving lines each have a circular cross section.

4. The capillary woven mesh structure as claimed in claim 1, wherein a line diameter of the multiple longitudinal single weaving lines is greater than a sum of line diameters of the multiple latitudinal weaving lines of multiple the latitudinal line sets.

5. The capillary woven mesh structure as claimed in claim 1, wherein the multiple longitudinal single weaving lines and the multiple latitudinal weaving lines of the multiple latitudinal line sets are made of metal material.

6. The capillary woven mesh structure as claimed in claim 1, wherein the capillary woven mesh structure is disposed in a two-phase fluid heat dissipation unit, the two-phase fluid heat dissipation unit including an upper plate and a lower plate, the upper plate being mated with the lower plate to together define a chamber, in which a working fluid is filled, the capillary woven mesh structure being disposed on an inner side of the lower plate of chamber.

7. The capillary woven mesh structure as claimed in claim 1, wherein the two-phase fluid heat dissipation unit is a vapor chamber.

* * * * *